US009534437B1

(12) United States Patent
Santelli, Jr.

(10) Patent No.: US 9,534,437 B1
(45) Date of Patent: Jan. 3, 2017

(54) WINDOW INSULATION SYSTEM

(71) Applicant: Red Devil Inc., Tulsa, OK (US)

(72) Inventor: Albert Santelli, Jr., Middlesex, NJ (US)

(73) Assignee: RED DEVIL INC., Tulsa, OK (US)

( * ) Notice: Subject to any disclaimer, the term of this patent is extended or adjusted under 35 U.S.C. 154(b) by 0 days.

(21) Appl. No.: 14/668,651

(22) Filed: Mar. 25, 2015

(51) Int. Cl.
*E06B 3/30* (2006.01)
*E04B 1/76* (2006.01)
*E06B 3/28* (2006.01)

(52) U.S. Cl.
CPC ..... *E06B 3/308* (2013.01); *E04B 1/76* (2013.01); *E06B 3/28* (2013.01)

(58) Field of Classification Search
CPC ..... E04B 1/76; E06B 3/308; E06B 3/28; E06B 9/02; E06B 2009/005; E06B 3/5871; E06B 9/52; E06B 9/582; E06B 1/04; E06B 1/34; E06B 1/36; E06B 2003/262; A47B 2230/0011
See application file for complete search history.

(56) References Cited

U.S. PATENT DOCUMENTS 3,416,275 A * 12/1968 van Loghem ..... E04B 1/48 52/282.3
3,939,620 A * 2/1976 Bero ..... E05D 1/02 52/476
4,065,900 A * 1/1978 Eggert ..... E06B 3/5871 52/476
4,184,297 A * 1/1980 Casamayor ..... E06B 3/5871 52/202
4,452,020 A * 6/1984 Werner ..... E06B 3/28 49/62
4,458,739 A * 7/1984 Murray ..... E06B 9/582 160/23.1
RE32,509 E * 9/1987 Werner ..... E06B 3/28 52/202
5,040,586 A * 8/1991 Hillstrom ..... G09F 17/00 160/327
5,253,457 A * 10/1993 Orth ..... E06B 3/28 49/62

(Continued)

OTHER PUBLICATIONS

YouTube Video, https://www.youtube.com/watch?v=n8ZIs6sbZIY, Aug. 1, 2014.

(Continued)

*Primary Examiner* — Phi A
*Assistant Examiner* — Omar Hijaz
(74) *Attorney, Agent, or Firm* — David A. Guerra

(57) ABSTRACT

The present invention is directed toward a window or door insulation system including an attachable trim strip, and a securable transparent sheet, to create a removable and auxiliary insulation sheet. The trim strip includes a base attachable to a surface, a cover pivotably connected to the base, and an interior strip pivotably connected to the cover and base. The cover includes a first wall, an intermediate wall transitioning from the first wall, and a second wall transitioning from the intermediate wall. The first wall is pivotably connected to a first side of the base so that the cover is configured to be an open position or a closed position. A gap is defined between the second wall of the cover and the second side of the base when in the closed position. The interior strip is configured to keep the cover opened or closed.

20 Claims, 3 Drawing Sheets

(56) References Cited

U.S. PATENT DOCUMENTS

| | | | | |
|---|---|---|---|---|
| 5,608,980 | A * | 3/1997 | Pangerl | G09F 15/0018 292/251.5 |
| 5,728,976 | A * | 3/1998 | Santucci | H02G 3/0418 174/135 |
| 6,050,037 | A * | 4/2000 | Gifford | E06B 1/62 52/211 |
| 6,412,538 | B1 * | 7/2002 | Welfonder | E06B 9/42 160/271 |
| 7,069,700 | B2 * | 7/2006 | Heissenberg | E06B 9/02 49/463 |
| 7,654,026 | B2 * | 2/2010 | Pitcher | A47G 1/0611 40/792 |
| 2001/0042331 | A1 * | 11/2001 | Ostrovsky | A47G 1/0611 40/793 |
| 2010/0147471 | A1 * | 6/2010 | Bull | E06B 9/52 160/381 |

OTHER PUBLICATIONS

The Home Depot, http://www.homedepot.com/p/Snap-N-Seal-64-in-Clear-Joiner-2150/204766469.

PR Newswire, "Red Devil Introduces Snap-N-Seal™ Window Insulator Kit", http://www.prnewswire.com/news-releases/red-devil-introduces-snap-n-seal-window-insulator-kit-282396201.html, Nov. 12, 2014.

* cited by examiner

WINDOW INSULATION SYSTEM

STATEMENT REGARDING PRIOR DISCLOSURES BY THE INVENTOR OR A JOINT INVENTOR

The following disclosure by the applicant, who obtained the subject matter disclosed directly from the inventor, is submitted under 35 U.S.C. 102(b)(1)(A):

A "grace period disclosure" was published on April 2014 and Aug. 1, 2014 by the applicant by way of a YouTube™ video. The Aug. 1, 2014 video was entitled "Snap N Seal".

The following disclosures are submitted under 35 U.S.C. 102(b)(1)(B):

A "grace period disclosure" was published on Nov. 12, 2014 by PR Newswire. This publication was entitled "Red Devil Introduces Snap-N-Seal™ Window Insulator Kit". PR Newswire obtained the subject matter directly from the applicant not more than one year before the effective filing date of the claimed invention.

A "grace period disclosure" was published on The Home Depot® website as "Snap-N-Seal". The Home Depot® obtained the subject matter directly from the applicant not more than one year before the effective filing date of the claimed invention.

BACKGROUND OF THE INVENTION

Field of the Invention

The present invention relates generally to a window insulation system for use in connection with insulating and/or protecting various openings in buildings or vehicles. More particularly, the invention relates to insulating windows of a building using a removable sheet via an attachable locking trim strip.

Description of the Prior Art

As wall insulating techniques and products have dramatically improved, windows have been the least efficient in a buildings overall thermal efficiency. A high-quality installation may minimize or reduce air leakage (draft) through a building envelope, decreasing infiltration and thus contributing to reduced heat loss in the winter and heat gain in the summer. However, there still exists a dramatic thermal loss and draft through standard and existing windows. This loss in thermal efficiency contributes to increased home utility costs, reduced personal comfort, and increased home maintenance.

While prior art might fulfill their respective, particular objectives and requirements, the prior art do not describe a window insulation system that allows insulating and protecting various openings in buildings or vehicles.

Therefore, a need exists for a new and improved window insulation system that can be used for insulating and protecting various openings in buildings or vehicles by reducing the window's draft and creating an additional insulation zone adjacent the window. In this regard, the present invention substantially fulfills this need. In this respect, the window insulation system according to the present invention substantially departs from the conventional concepts and designs of the prior art, and in doing so provide an apparatus primarily developed for the purpose of insulating and protecting various openings in buildings or vehicles.

SUMMARY OF THE INVENTION

In view of the foregoing disadvantages inherent in the known types of window insulating systems now present in the prior art, the present invention provides an improved window insulation system, and overcomes the above-mentioned disadvantages and drawbacks of the prior art. As such, the general purpose of the present invention, which will be described subsequently in greater detail, is to provide a new and improved window insulation system and method which has all the advantages of the prior art mentioned heretofore and many novel features that result in a window insulation system which is not anticipated, rendered obvious, suggested, or even implied by the prior art, either alone or in any combination thereof.

To attain this, the present invention essentially comprises an insulation system attachable to a window or door. The system includes a base attachable to a surface, and a cover pivotably connected to the base. The cover includes a generally open channeled cross-section having a first cover side and a second cover side. The cover is pivotably connected to the base so that the cover is configured to be in at least one of an open position or a closed position. A gap is defined between the second cover side and the second side of the base when in the closed position. The present invention is configured to receive an edge of a sheet therein, and the gap is configured to receive the sheet therethrough thereby securing the sheet in place.

The base and the cover are in the form of a trim strip, which further includes an interior strip. The interior strip features a first side pivotably connected to a portion of the cover, and a second side pivotably connected to a portion of the base. The interior strip runs along a longitudinal axis of the trim strip.

Still further, the cover includes a first wall featuring the first cover side, a second wall featuring the second cover side, and an intermediate wall transitioning between the first wall and the second wall. The first wall of the cover is pivotably connected to the first side of the base via a first pivot connection being a flexure bearing.

There has thus been outlined, rather broadly, the more important features of the invention in order that the detailed description thereof that follows may be better understood and in order that the present contribution to the art may be better appreciated.

The invention may also include a lip received in a channel defined in the base, and a strip received in a channel defined in the intermediate wall of the cover. The lip extends from the base and is configured to contact a first side of the sheet received in and interior of the trim strip. The strip extends from the intermediate wall and is configured to contact a second side of the sheet when the cover is in the closed position. There are, of course, additional features of the invention that will be described hereinafter and which will form the subject matter of the claims attached.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved window insulation system that has all of the advantages of the prior art window insulation devices and none of the disadvantages.

It is another object of the present invention to provide a new and improved window insulation system that may be easily and efficiently manufactured and marketed.

An even further object of the present invention is to provide a new and improved window insulation system that has a low cost of manufacture with regard to both materials and labor, and which accordingly is then susceptible of low prices of sale to the consuming public, thereby making such window insulation system economically available to the buying public.

Still another object of the present invention is to provide a new window insulation system that provides in the apparatuses and methods of the prior art some of the advantages thereof, while simultaneously overcoming some of the disadvantages normally associated therewith.

Even still another object of the present invention is to provide a window insulation system for insulating and protecting various openings in buildings or vehicles. This allows for the creation of an insulation barrier for virtually any existing window.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DETAILED DESCRIPTION OF THE INVENTION

Figure 1:
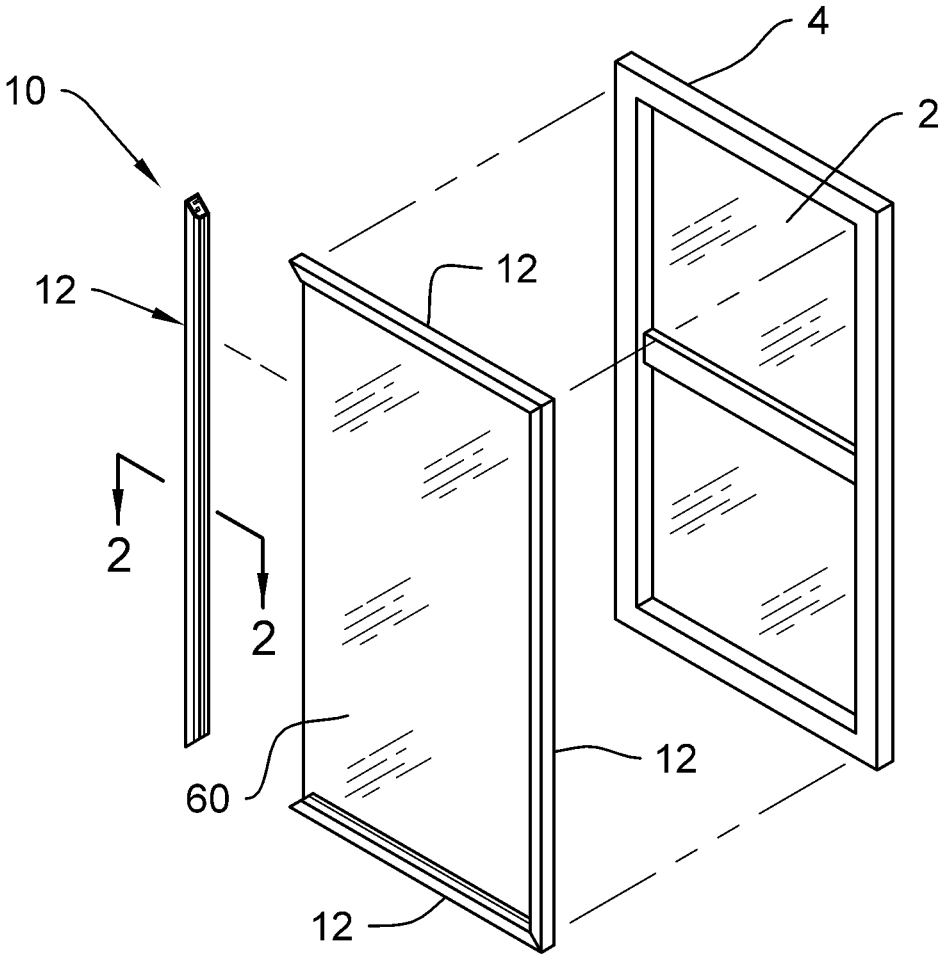
FIG. 1 is an exploded perspective view of an embodiment of the window insulation system constructed in accordance with the principles of the present invention, with the phantom lines depicting environmental structure and forming no part of the claimed invention.

Referring now to the drawings, and particularly to FIGS. 1-5, an embodiment of the window insulation system of the present invention is shown and generally designated by the reference numeral 10.

In FIG. 1, a new and improved window insulation system 10 of the present invention for insulating and protecting various openings, such as but not limited to, windows or doors 2 in buildings or vehicles is illustrated and will be described. More particularly, the window insulation system 10 has a trim piece or strip 12 permanently or removably mounted to a window or door frame 4. The trim strip 12 creates a border that removable secures a sheet 60 across the window or door 2, thereby creating an insulated barrier and zone between the window 2 and sheet 60. The sheet 60 can also act as a protection barrier from intruders or during storms to retain any broken glass or flying debris.

The trim strip 12 has a longitudinal length and includes a base 14, and a cover 30 pivotably connected to the base 14 allowing the cover 30 to be in an open or closed position. The trim strip 12 is made from a material that can be cut and painted, such as but not limited to, plastics, woods, metals or composites. It can be appreciated that the trim strip 12 can be manufactured by, but not limited to, an extrusion process, and can be embossed with designs and/or decorations.

Figure 5:
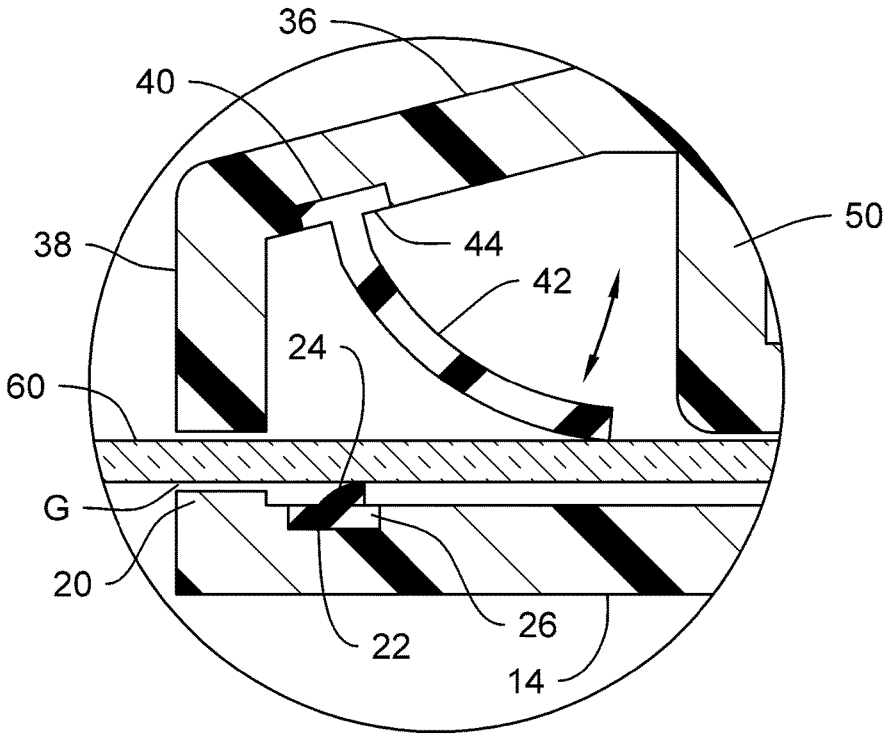
FIG. 5 is an enlarged cross-sectional view of a portion of the present invention taken at section 5 in FIG. 4.

The base 14 is substantially planar with a longitudinal length featuring a bottom surface that is attachable to a surface or frame 4 by way of an adhesive 16 exposed by a peel away cover 18. The base 14 has a second side or end 20, a first side or edge opposite the second side 20, and a base wall 28 extending from the base 14 in a direction away from the surface 4. The base wall 28 can be perpendicular to the base 14. It can be appreciated that the base 14 can be attached to the surface 4 by means other than the adhesive 16, such as but not limited to, fasteners, clips, snaps, magnets or separable fasteners, A channel 22 is defined along the longitudinal length of the base 14 adjacent or near the second side 20. A lip 24 has a lip base 26 which is received in the channel 22. The lip 24 extends from the base 14 in a direction away from the surface 4. The lip 24 is configured to contact the sheet 60 when installed. The lip 24 can have a straight, an arcuate or curved configuration, and can be deformable upon contact with the sheet 60 to form a tight seal thereagainst, as best illustrated in FIG. 5. The lip 24 can be made from, but not limited to, rubber, plastics, composites, foam, polymers or any deformable material.

The cover 30 includes a first wall 32, an intermediate wall 34 transitioning from the first wall 32, and a second wall 38 transitioning from the intermediate wall 34. A side or edge of the first wall 32 is pivotably connected to the first side or edge of the base 14 by way of a flexure bearing or living hinge 29, thus allowing the cover 30 pivot to the open or closed position. The first wall 32 and second wall 38 are substantially parallel with each other, with the intermediate wall 34 laterally extending therebetween, thereby creating a generally C-shape with an open interior that faces the base 14 in the closed position. The intermediate wall 34 substantially runs the width of the trim strip 12, and can include an angled section 36 toward the second wall 38. The flexure bearing 29 can run the entire longitudinal length of the base 14 and cover 30. It can be appreciated that other types of hinges or pivoting means can be used in place of the flexure bearing 29, and that the flexure bearing 29 can be multiple bearings located intermitted along the base 14. It can further be appreciated that the cover 30 can be any open channel strip featuring spaced apart sides or edges and having a configuration, such as but not limited to, arcuate, V-shaped, curved, geometric or cylindrical.

A cover channel 40 is defined along the longitudinal length of the angled section 36, adjacent or near the second wall 38. A cover strip 42 has a strip base 44 which is received in the cover channel 40. The cover strip 42 extends from the angled section 36 into the interior of the cover 30, and is configured to contact the sheet 60 when the cover 30 is in the closed position. The cover strip 42 can have a straight, an angled, an arcuate or curved configuration, and can be deformable upon contact with the sheet 60 to form a tight seal against a side of the sheet 60 opposite the lip 24, as best illustrated in FIG. 5. The cover strip 42 can be made from, but not limited to, rubber, plastics, composites, foam, polymers or any deformable material.

Figure 2:
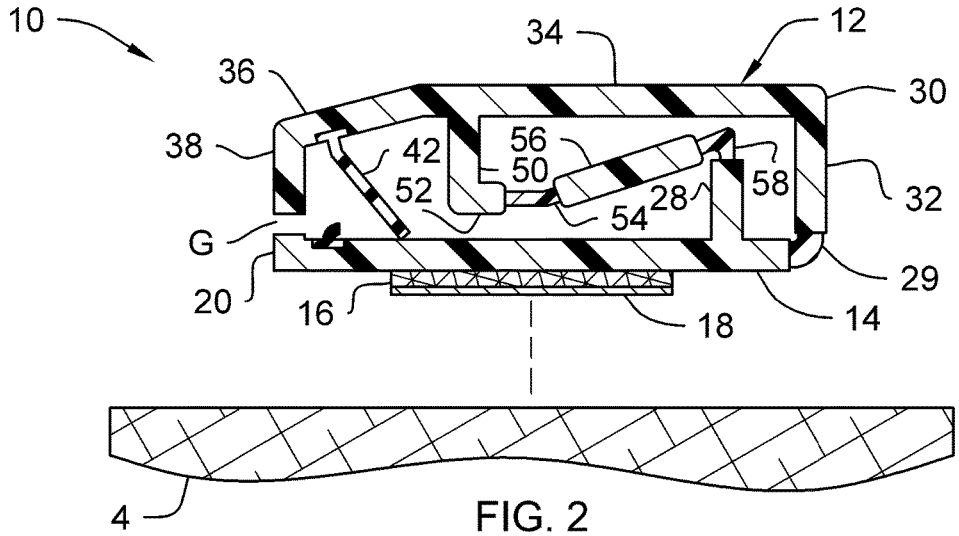
FIG. 2 is a cross-sectional view of the present invention taken along line 2-2 in FIG. 1.
Figure 3:
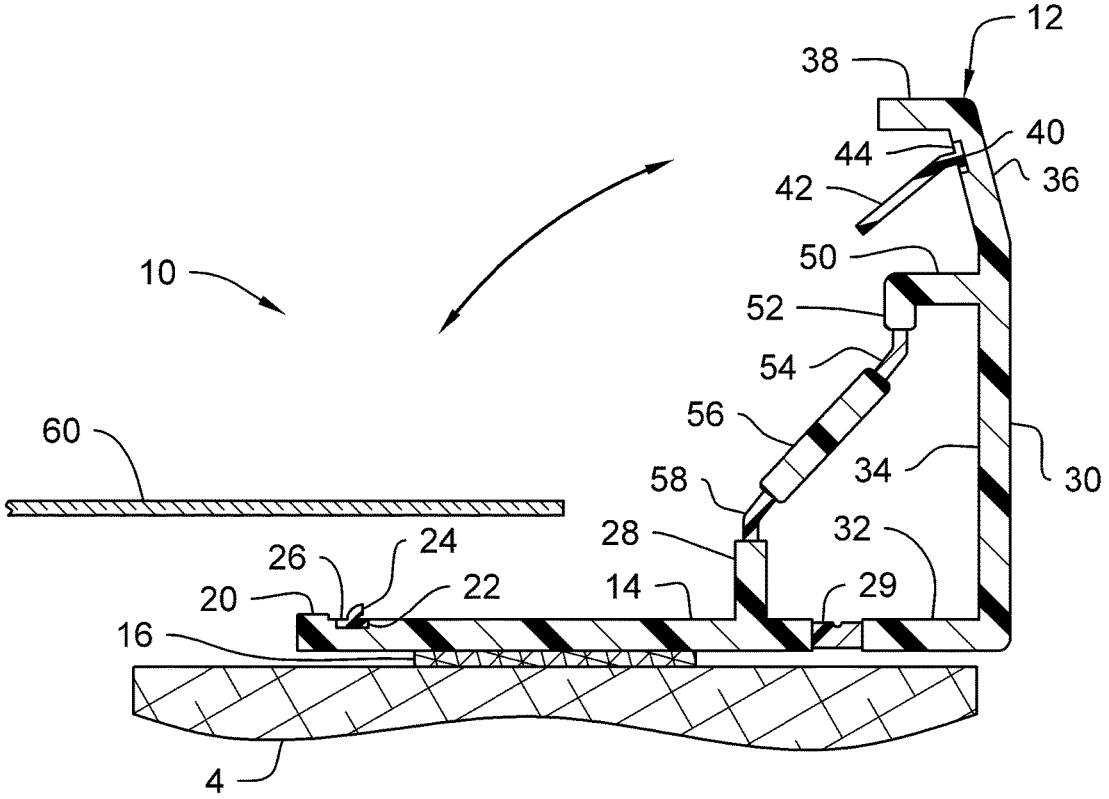
FIG. 3 is a cross-sectional view of the present invention in an opened position.
Figure 4:
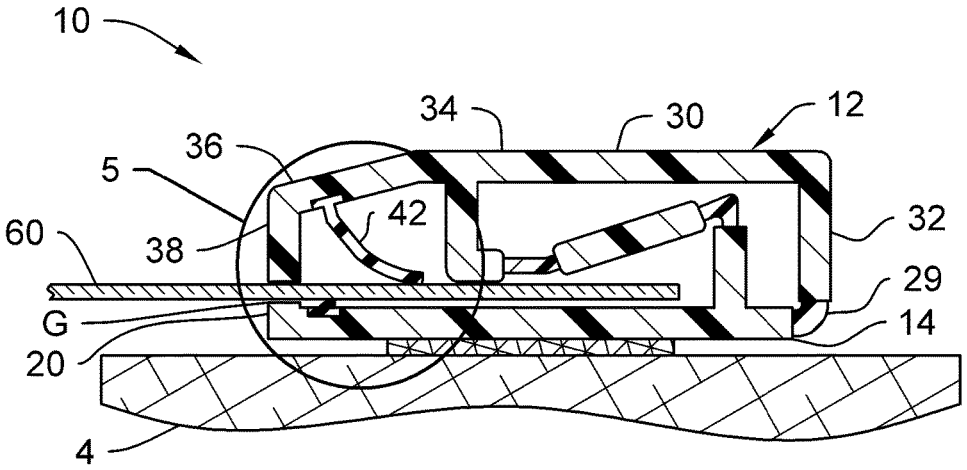
FIG. 4 is a cross-sectional view of the present invention in a closed position.

The length of the second wall 38 is configured to create a gap G between the second side 20 of the base 14 and a free end of the second wall 38 when the cover 30 is in the closed position. The distance of the gap G is configured to allow the sheet 60 to pass therethrough, as best illustrated in FIGS. 2 and 4.

The cover additionally, includes a third wall 50 that extends from the intermediate wall 34 into the interior of the cover 30, and is located between the first wall 32 and second wall 38. The third wall 50 is parallel with the first wall 32 and the second wall 38. The third wall 50 further includes an extension end 52 that perpendicularly extends from a free end of the third wall 50. The extension end 52 can be parallel with the intermediate wall 34.

An interior strip 56 is located in the interior of the base 14 and the cover 30, and includes a first side or edge pivotably connected to an end of the extension end 52 by way of a flexure bearing or living hinge 54, and a second side or edge pivotably connected to an end of the base wall 28 by way of a flexure bearing or living hinge 58. The interior strip 56 runs along the longitudinal length of the base 14 and the cover 30. The interior strip 56 can have a thickness greater than the adjacent flexure bearings 54, 58, and can be made of a material different than the flexure bearings 54, 58.

One of or both of the flexure bearings 54, 58 is configured to either be biased against the interior strip 56 to urge the cover 30 to the open or closed position, or can keep the cover 30 in the open or closed position by locking the interior strip 56 in a predetermined position.

The sheet 60 is removably received and secured in the interior of the trim strip 12 between the base 14 and the cover 30. The sheet 60 can be a transparent, translucent or opaque sheet made from, but not limited to, acrylic, plastics, polymers, composites, metals, alloys, rubber or glass. It can be appreciated that optional means to secure the sheet 60 in the trim strip 12 can be use, such as but not limited to, adhesives, magnets, clips, fasteners, latches or friction.

In use, it can now be understood that a person would measure the lengths of the frame 4 around the window or door 2, and then cut the trim strip 12 according to each measurement. The peel away cover 18 from each trim strip 12 can be removed to expose the adhesive 16 so that the trim strip 12 can then be adhered to the frame 4 by applying pressure thereagainst. The trim strips 12 should be arranged on the frame 4 so that the second side 20 of the base 14 face toward each other.

The person could then measure the length and width of the window 2 or between oppositely facing base walls 28. The sheet 60 is then cut to these measurements so as to fit between the oppositely facing base walls 28.

The cover 30 of each trim strip 12 can be pivoted to the open position, and the sheet 60 can then be installed within the trim strips 12. The base wall 28 can also act as a guide during installation of the sheet 60. After which, each of the covers 30 can be closed and locked in the closed position, thereby securing the sheet 60 in position. It can be appreciated that locking tabs with an angled face (not shown) can be incorporated with the base wall 28 to securely retain the sheet 60 in position against the base 14.

With the sheet 60 secured and the cover 30 locked in the closed position, each lip 24 and cover strip 42 is sealed against their corresponding side of the sheet 60, thereby creating an insulated space between the window 2 and the sheet 60.

To remove the sheet 60, at least one of the covers 30 are pivoted to the open position, and the sheet 60 can then be freely removed.

It can be appreciated that the sheet 60 can include designs thereon to provide a more pleasing appearance. It can also be appreciated that the trim strip 14 or sheet 40 can include reinforcement members to add a level of security or protection to the window or door 2. It can further be appreciated that the trim strip 12 and the sheet 60 can be included in a kit, which can further include a user's manual, a measuring instrument, and a cutting device (not shown).

While embodiments of the window insulation system have been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any suitable sturdy material such as metal, plastic, composites or a variety of wood may be used instead of the above described. And although insulating and protecting various openings in buildings or vehicles have been described, it should be appreciated that the window insulation system herein described is also suitable for providing a protective and safety barrier to window and/or door openings to deter access through the opening.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An insulation system attachable to a window or door, said insulation system comprising:

a base attachable to a surface, said base comprising a first side, and a second side, said first side and said second side being located on a plane of said base;

a lip including a lip base received in a channel defined in said base, said lip extends from said base and has a configuration capable of contacting a sheet;

a cover having a generally open channeled cross-section comprising a first cover side and a second cover side, said cover being pivotably connected to said base so that said cover is configured to be in at least one of an open position or a closed position, in said closed position a gap is defined between said second cover side and said second side of said base; and an interior strip featuring a first strip end pivotably connected to a portion of said cover, and a second strip end pivotably connected to a portion of said base, said interior strip runs along a longitudinal length of said base and said cover;

wherein said base and said cover are configured to receive an edge of said sheet therebetween, and said gap is configured to receive a portion of said sheet therethrough;

wherein said second side of said base features a free end extending from said base in a direction toward said second cover side of said cover to define said gap, said free end of said second side of said base protrudes out past said lip base in a direction toward said cover when in said closed position;

wherein said cover being pivotably connected to said base by way of a first pivot connection, with at least a portion of said first pivot connection being on said plane of said base.

2. The insulation system as claimed in claim 1, wherein said base further comprising a base wall extending from said base away from the surface, said base wall is configured to prevent advancement of said sheet a predetermined distance when in at least said cover is in said closed position.

3. The insulation system as claimed in claim 2, wherein said cover further comprising a first wall featuring said first cover side, a second wall featuring said second cover side, and an intermediate wall transitioning between said first wall and said second wall, and wherein said first wall of said cover is pivotably connected to said first side of said base by way of said first pivot connection being a flexure bearing.

4. The insulation system as claimed in claim 3, wherein said cover further comprising a third wall extending from said intermediate wall toward said base when in said closed position, said third wall being located between said first and second walls.

5. The insulation system as claimed in claim 4, wherein said first, second and third walls of said cover are parallel, and extend toward said base when said cover is in said closed position.

6. The insulation system as claimed in claim 4, wherein said first strip end of said interior strip is pivotably connected to said third wall of said cover by way of a second pivot connection, and said second strip end of said interior strip is pivotably connected to said base wall of said base by way of a third pivot connection.

7. The insulation system as claimed in claim 6, wherein at least one of said second pivot connection, and said third pivot connection is biasedly configured to urge said cover toward one of said open position or said closed position.

8. The insulation system as claimed in claim 6, wherein at least one of said second pivot connection, and said third pivot connection is configured to position said interior strip in a predetermined position that keeps said cover in one of said open position or said closed position when said cover is pivoted a predetermined distance.

9. The insulation system as claimed in claim 6, wherein said second and third pivot connections are each a flexure bearing.

10. The insulation system as claimed in claim 9, wherein said third wall further comprising an extension end that perpendicularly extends from a free end of said third wall, said second pivot connection connects said first side strip end of said interior strip to said extension end.

11. The insulation system as claimed in claim 1, wherein said lip base featuring a flat side and a width, said flat side of said lip base is received in said channel, said width of said lip base is greater than a width of a remaining portion of said lip.

12. The insulation system as claimed in claim 11, wherein said lip has a generally arcuate configuration, and is configured to deform on contact with said sheet when said cover is in said closed position.

13. The insulation system as claimed in claim 12, wherein said cover further comprising a strip received in a channel defined in said cover, said strip extends from said cover and is configured to contact said sheet when said cover is in said closed position, wherein said strip includes a strip base featuring a flat side and a width, said flat side of said strip base is received in said channel defined in said cover.

14. The insulation system as claimed in claim 13, wherein said strip includes a first strip section that extends from said strip base at a first angle, and a second strip section that extends from said first strip section at second angle different from said first angle, wherein at least said first strip section is configured to deform on contact with said sheet when said cover is in said closed position, said width of said strip base is greater than a width of said first strip section and said second strip section, and wherein a length of said strip is greater than a length of said lip.

15. The insulation system as claimed in claim 1, wherein the surface is a frame selected from the group consisting of a window, a door, a skylight, a sunroof, a hatchway, and an access port.

16. The insulation system as claimed in claim 1, wherein said sheet is a substantially transparent planar sheet.

17. An insulation system comprising:

a trim strip comprising:

a base attachable to a surface, said base comprising a first side, a second side, a lip, and a base wall extending from said base away from the surface, said lip being received in a channel defined in said base, said lip includes a lip base featuring a flat side and a width, said flat side of said lip base being received in said channel, said width of said lip base is greater than a width of a remaining portion of said lip;

a cover having a generally open channeled cross-section, said cover comprising a cover strip, a first wall, an intermediate wall transitioning from said first wall, a second wall transitioning from said intermediate wall, and a third wall extending from said intermediate wall toward said base when in said closed position, said third wall being located between said first and second walls, said first wall being pivotably connected to said first side of said base so that said cover is configured to be in at least one of an open position and a closed position, in said closed position a gap is defined between said second wall of said cover and said second side of said base, said cover strip being received in a channel defined in said cover, and wherein said cover strip includes a strip base featuring a flat side and a width, said flat side of said strip base being received in said channel defined in said cover an interior strip featuring a first side pivotably connected to said third wall of said cover by way of a second pivot connection, and a second side pivotably connected to said base wall of said base by way of a third pivot connection, said interior strip running along a longitudinal axis of said base and said cover; and a sheet removably received and secured in an interior of said trim strip between said base and said cover when in said closed position;

wherein said gap is configured to receive said sheet therethrough;

wherein said lip extends from said base and has a configuration capable of contacting a first side of said sheet when in said closed position, said cover strip extends from said cover and has a configuration capable of contacting a second side of said sheet when said cover is in said closed position.

18. The insulation system as claimed in claim 17, wherein said first side and said second side of said base are located on a plane of said base, wherein said second side of said base features a free end extending from said base in a direction toward said second cover side of said cover to define said gap, and wherein said first wall of said cover is pivotably connected to said first side of said base by way of a first pivot connection, with at least a portion of said first pivot connection being on said plane of said base.

19. The insulation system as claimed in claim 4, wherein said base wall is located between said first wall of said cover and said third wall of said cover when said cover is in said closed position.

20. The insulation system as claimed in claim 4, wherein said third wall features a free end having a configuration capable of defining a spaced apart relationship between said free end and said second side of said base when said cover is in said closed position, said spaced apart relationship having a configuration capable of receiving said sheet therethrough.

* * * * *